US007657002B2

(12) United States Patent
Burke et al.

(10) Patent No.: US 7,657,002 B2
(45) Date of Patent: Feb. 2, 2010

(54) CATHODE HEAD HAVING FILAMENT PROTECTION FEATURES

(75) Inventors: James Burke, Glenview, IL (US); Charles Lynn Chidester, West Bountiful, UT (US); Bruce A Cain, South Jordan, UT (US); Rob Treseder, Salt Lake City, UT (US); James Boye, Salt Lake City, UT (US); Ray Daly, Biloxi, MS (US); Ricky Smith, Sandy, UT (US); Paul Gene Christean, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 21 days.

(21) Appl. No.: 11/343,599

(22) Filed: Jan. 31, 2006

(65) Prior Publication Data

US 2007/0183576 A1 Aug. 9, 2007

(51) Int. Cl.
*H01J 35/06* (2006.01)

(52) U.S. Cl. ..... 378/136

(58) Field of Classification Search ..... 378/136, 378/137, 138

See application file for complete search history.

(56) References Cited

U.S. PATENT DOCUMENTS 4,368,538 A * 1/1983 McCorkle ..... 378/122
4,673,842 A 6/1987 Grieger et al.
5,031,200 A * 7/1991 Plessis et al. ..... 378/136
5,125,019 A * 6/1992 Evain et al. ..... 378/137
5,623,530 A * 4/1997 Lu et al. ..... 378/136
6,263,045 B1 * 7/2001 Lipkin et al. ..... 378/136
6,438,207 B1 * 8/2002 Chidester et al. ..... 378/138
6,526,122 B2 * 2/2003 Matsushita et al. ..... 378/138
6,801,599 B1 * 10/2004 Kautz et al. ..... 378/138
6,968,039 B2 * 11/2005 Lemaitre et al. ..... 378/138
6,980,623 B2 * 12/2005 Dunham et al. ..... 378/19
7,062,017 B1 6/2006 Runnoe ..... 378/136
7,327,829 B2 * 2/2008 Chidester ..... 378/136

FOREIGN PATENT DOCUMENTS

WO 97/49115 12/1997

* cited by examiner

*Primary Examiner*—Allen C. Ho
(74) *Attorney, Agent, or Firm*—Workman Nydegger

(57) ABSTRACT

A cathode assembly including certain features designed to protect the integrity of a filament contained therein is disclosed. In particular, the cathode assembly is configured to prevent damage to the filament should it inadvertently contact another portion of the cathode assembly. In an example embodiment, an x-ray tube incorporating features of the present invention is disclosed. The x-ray tube includes an evacuated enclosure containing a cathode assembly and an anode. The cathode assembly includes a head portion having a head surface. A slot is defined on the head surface and an electron-emitting filament is included in the slot. A protective surface is defined on the head surface proximate to a central portion of the filament. The protective surface in one embodiment is composed of tungsten and is configure to prevent fusing of the filament to the protective surface should the filament inadvertently contact the protective surface.

21 Claims, 6 Drawing Sheets

CATHODE HEAD HAVING FILAMENT PROTECTION FEATURES

BACKGROUND

1. Technology Field

The present invention generally relates to x-ray generating devices. In particular, the present invention relates to features for implementation in a cathode of an x-ray tube, for example, that prevents contamination or damage to a filament during high temperature operation.

2. The Related Technology

X-ray producing devices, such as x-ray tubes, are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray tubes operate in similar fashion. In general, x-rays are produced when electrons are emitted, accelerated, and then impinged upon a material of a particular composition. This process typically takes place within an evacuated enclosure of the x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by a bearing assembly. The evacuated enclosure is typically contained within an outer housing, which also serves as a reservoir for a coolant, such as dielectric oil, that serves both to cool the x-ray tube and to provide electrical isolation between the tube and the outer housing.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted as a beam through windows defined in the evacuated enclosure and the outer housing. The emitted x-ray beam is then directed toward an x-ray subject, such as a medical patient, so as to produce an x-ray image.

In order to produce as focused an x-ray beam as possible, it is generally preferred to first shape or focus the stream of electrons emitted from the cathode filament. Such control of electron emission at the cathode in turn results in precise electron impact at the desired location on the anode target surface for desirably focused x-ray emission. Similarly, electron stream shaping by the cathode head prevents "wings," which are streams of off-focus electrons that serve no purpose other than the reduce the clarity of the resulting x-ray image.

As such, cathodes used in x-ray tubes and other filament-containing devices typically include a head portion that houses the filament. The cathode head can be shaped in order to desirably focus the electrons that are produced by the filament, as mentioned above. Often, the filament is positioned in one or more slots or similar structures that are defined in the cathode head for electron focusing. Further, a close tolerance often exists between the filament and the head surface defining the slot structure, as it has been recognized that minimizing the spacing between the filament and surfaces of the cathode head enables the electron stream to be shaped off-focus wings to be minimized with relatively lower cathode control voltages than what would otherwise be possible.

Unfortunately, the placement of the filament in close proximity to portions of the cathode head, such as slot sides or other similar features, undesirably raises the risk of inadvertent contact of the filament with the cathode head surface during operation of the cathode-containing device, such as an x-ray tube. In detail, during tube operation the filament is electrically energized at a high temperature in order to produce electrons by thermionic emission. At such times, inadvertent contact between the filament and the proximate cathode head surface may occur. Such contact may be precipitated by a transient event, such as mechanical shock to the cathode, a relative voltage spike, or some other occurrence.

Should undesired contact between the filament and cathode head structure occur, damage to the filament may result. In particular, the filament is typically composed of a high melting point, refractory material such as tungsten in order to withstand the temperatures necessary for thermionic emission to be achieved. Cathode heads, in contrast, are often composed of materials that are selected for high voltage compatibility and machinability. Examples of such materials include nickel and nickel alloys, steel, stainless steel, iron and iron alloys, and copper. These materials have melting points lower than that of tungsten. As such, when the hot filament inadvertently contacts the cathode head, it can fuse to the cathode head surface, thus electrically shorting the filament and rendering the cathode unusable.

In other known cathode head configurations, contact between the filament and the cathode head surface is not necessary for damage to nonetheless occur to the filament. For instance, heat emitted from the filament during operation is absorbed by portions of the head structure proximate to the filament. If the proximate head structure is composed of a lower melting point material such as nickel, evaporation of nickel from the head will occur. The nickel evaporate can then redeposit on the filament surface, thereby contaminating the filament and reducing its performance. This filament contamination effect can also occur when the filament touches the head surface but fails to permanently weld to it.

The above-described challenges can be exacerbated in cathode heads that employ "gridding," a technique used to further control electron emission from cathode by selectively varying the relative electric potential between the filament and the head structure. Unfortunately, however, gridding can often increase relative electrical attraction between the filament and the head structure, thereby increasing chances for undesirable filament contact with the head surface.

Previous attempts to mitigate the above-described challenges have met with only limited success. For instance, cathode head designs have been altered to increase the filament-to-head surface spacing in order to reduce the likelihood of filament-to-head surface contact. But this unfortunately requires that a relatively greater amount of voltage be used to control the filament electron stream during cathode operation.

In light of the above discussion, a need currently exists for filament and cathode assemblies that resolve the challenges described above. In particular, there is a need for a cathode assembly suitable for use in x-ray and other cathode-containing devices that prevents damage to or destruction of a filament from structures proximate thereto during device operation. Any solution should be suitable for filaments employed in stationary and rotary anode x-ray tubes, as well as any devices where unintentional welding or contamination of high temperature filaments is a risk.

SUMMARY

The present invention has been developed in response to the above and other needs in the art. Briefly summarized, embodiments of the present invention are directed to a cathode assembly including certain features designed to protect the integrity of a filament contained therein. In particular, the cathode assembly is configured to prevent damage to the filament should it inadvertently contact another portion of the cathode assembly. In contrast to known cathode assemblies, embodiments of the present invention prevent fusing of the filament to the cathode head surface when a transient shock event causes the filament to momentarily contact a portion of the cathode head surface. In addition, contamination of the filament by material evaporated from the cathode head surface during high temperature filament operation is also reduced or eliminated in cathode assemblies implementing embodiments of the present invention.

In an example embodiment, an x-ray tube incorporating features of the present invention is disclosed. The x-ray tube includes an evacuated enclosure containing a cathode assembly and an anode. The cathode assembly includes a head portion having a head surface. A recess is defined on the head surface and an electron-emitting filament is included in the recess. A protective surface is defined on the head surface proximate to a central portion of the filament. The protective surface in one embodiment is composed of tungsten and is configured to prevent fusing of the filament to the cathode head should the filament inadvertently contact the protective surface. Preferably, the protective surface is placed on the head surface where filament contact is most likely, thereby preventing the filament from fusing to contacting portions of the head surface.

In one implementation, the protective surface of the cathode head is defined on a tungsten insert that is affixed within a recess defined in the head. In another implementation, the protective surface is a tungsten coating applied to a portion of the cathode head surface. As filaments are typically composed of tungsten, contact between the tungsten filament and the tungsten protective surface prevents melting and fusing of either surface to the other. In other embodiments other refractory and additional materials can be employed to form the protective surface.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1-4 depict various features of embodiments of the present invention, which is generally directed to a cathode head assembly having features designed to reduce or prevent damage to a filament portion of the assembly during operation. In one example implementation, the cathode head assembly is included as a component of an x-ray tube device, wherein the filament is employed to produce electrons preparatory for x-ray production. However, it is recognized that other high-temperature filament-containing devices can also benefit from the principles described herein. As such, the discussion to follow should be considered merely exemplary of the broader principles of the present invention.

Figure 1:
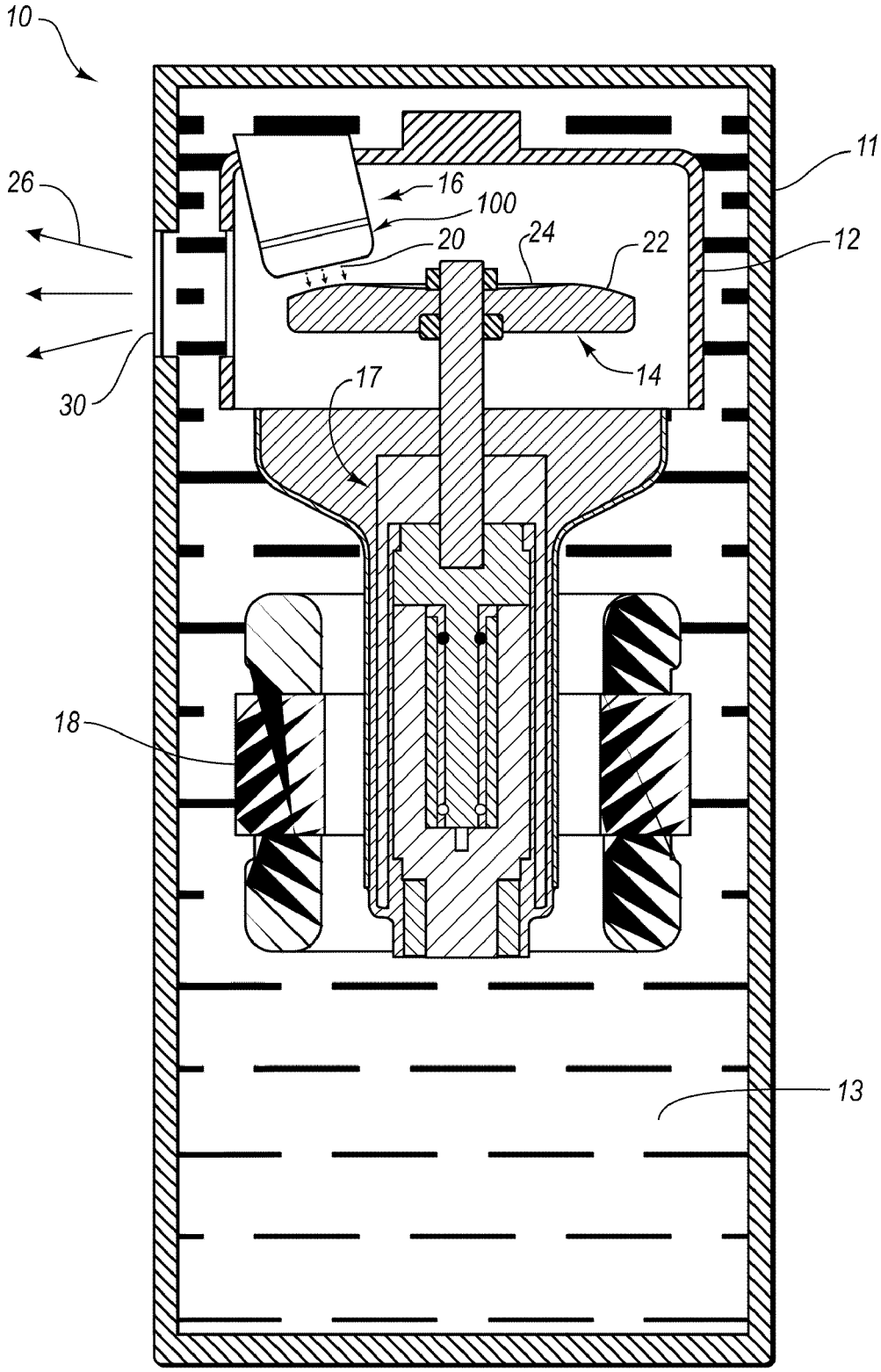
FIG. 1 is a simplified cross sectional view of a rotary anode x-ray tube that includes a cathode configured in accordance with one embodiment of the present invention.

Reference is first made to FIG. 1, which illustrates a simplified structure of a conventional rotating anode-type x-ray tube, designated generally at 10. X-ray tube 10 includes an outer housing 11, within which is positioned an evacuated enclosure 12. A coolant 13 is also disposed within an interior reservoir defined by the outer housing 11. The coolant envelops at least a portion of the evacuated enclosure 12 so as to assist in the cooling of the evacuated enclosure and the components contained therein. In addition, the coolant is typically a dielectric so as to provide electrical isolation between the evacuated enclosure and the outer housing. In one embodiment, the coolant 13 comprises a dielectric oil medium, which provides desirable thermal and electrical insulating properties. However, any one of a number of different coolant mediums could be utilized. In other implementations, no liquid coolant is employed and the tube is cooled by air circulation, for instance.

In the illustrated embodiment, there is positioned within the evacuated enclosure 12 a rotating anode 14 and a cathode 16. Here, the anode 14 is spaced apart from and oppositely disposed to the cathode 16, and is at least partially composed of a thermally conductive material such as copper or a molybdenum alloy—although other implementations could be utilized. In this embodiment, the anode 14 is rotatably supported by a rotor assembly 17. The rotor assembly 17 provides rotation of the anode 14 during tube operation via a rotational force provided by a stator 18. Note that in other embodiments, the anode can be a stationary anode disposed within a stationary anode x-ray tube.

The cathode 16 includes a filament, discussed further below, that is connected to an appropriate power source (not shown) such that during tube operation, an electrical current is passed through the filament to cause electrons, designated at 20, to be emitted from the cathode by thermionic emission. Application of a high electric potential between the anode 14 and the cathode 16 causes the electrons 20 emitted from the filament to accelerate from the cathode toward a focal track 22 that is positioned on a target surface 24 of the rotating anode 14. The focal track 22 is typically composed of tungsten or a similar material having a high atomic ("high Z") number. As the electrons 20 accelerate, they gain a substantial amount of kinetic energy, and upon striking the target material on the focal track 22, some of this kinetic energy is converted into electromagnetic waves of very high frequency, i.e., x-rays 26, shown in FIG. 1.

A significant portion of the x-rays 26 produced at the anode target surface pass through the evacuated enclosure 12 and are directed through a window 30 positioned in the outer housing 11. The x-rays 26 can then be used for a variety of purposes, according to the intended application. For instance, if the x-ray tube 10 is located within a medical x-ray imaging device, the x-rays 26 emitted from the x-ray tube are directed for penetration into an object, such as a patient's body during a medical evaluation for purposes of producing a radiographic image of a portion of the body.

Figure 2A:
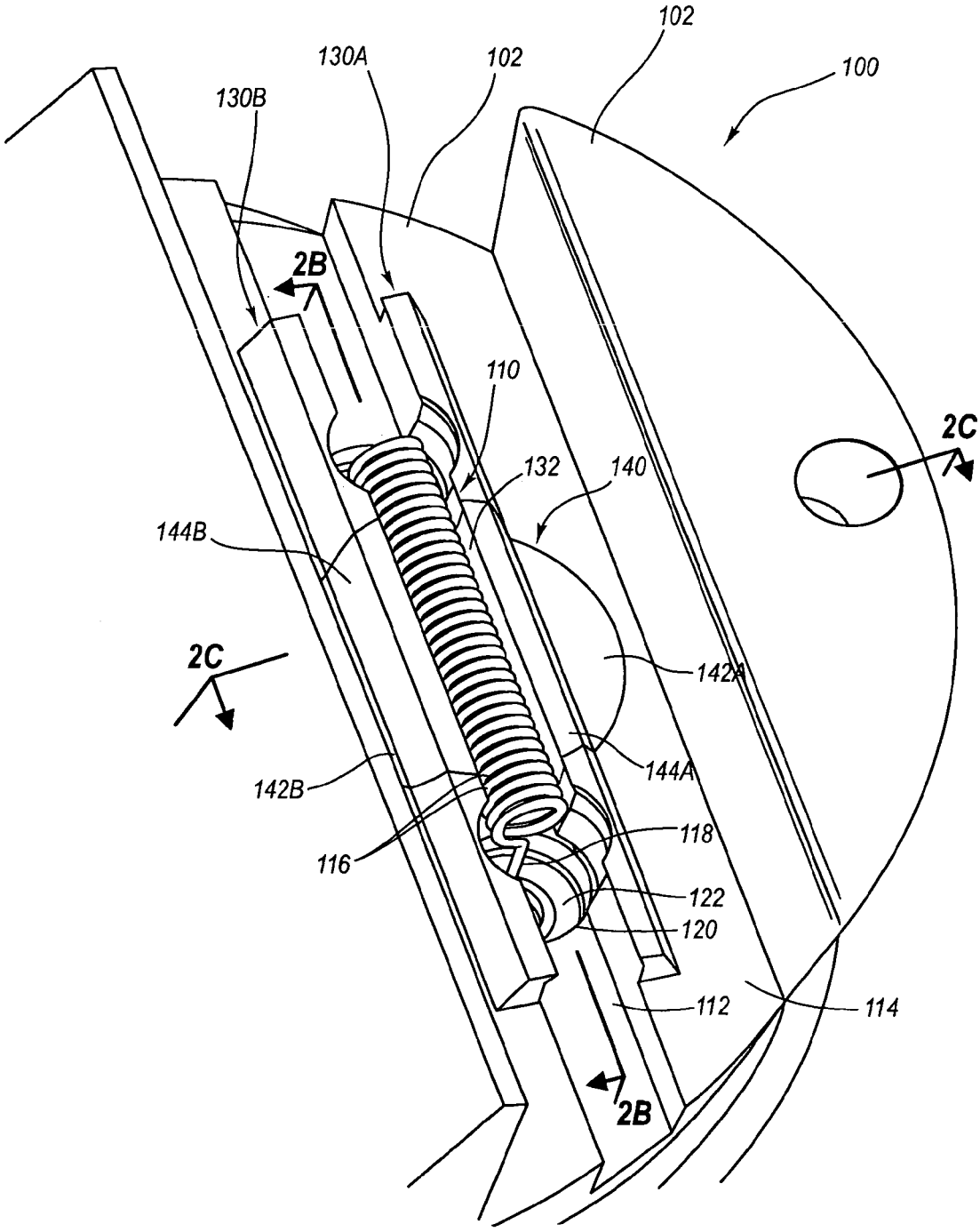
FIG. 2A is a perspective view of a portion of a cathode head configured in accordance with one embodiment.
Figure 2B:
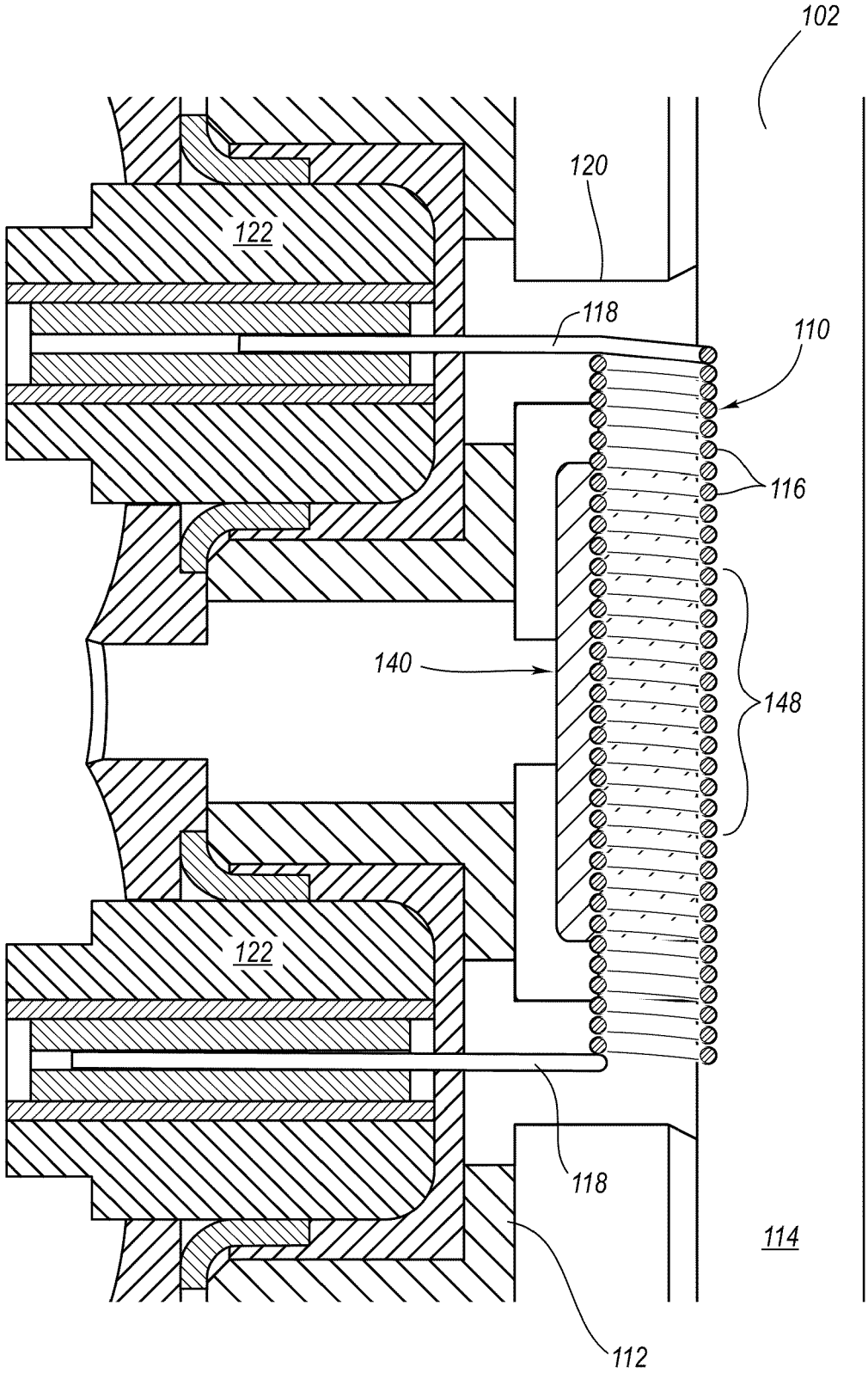
FIG. 2B is a cross sectional side view of the cathode head, taken along the line 2B-2B, of FIG. 2A, illustrating various features thereof.
Figure 2C:
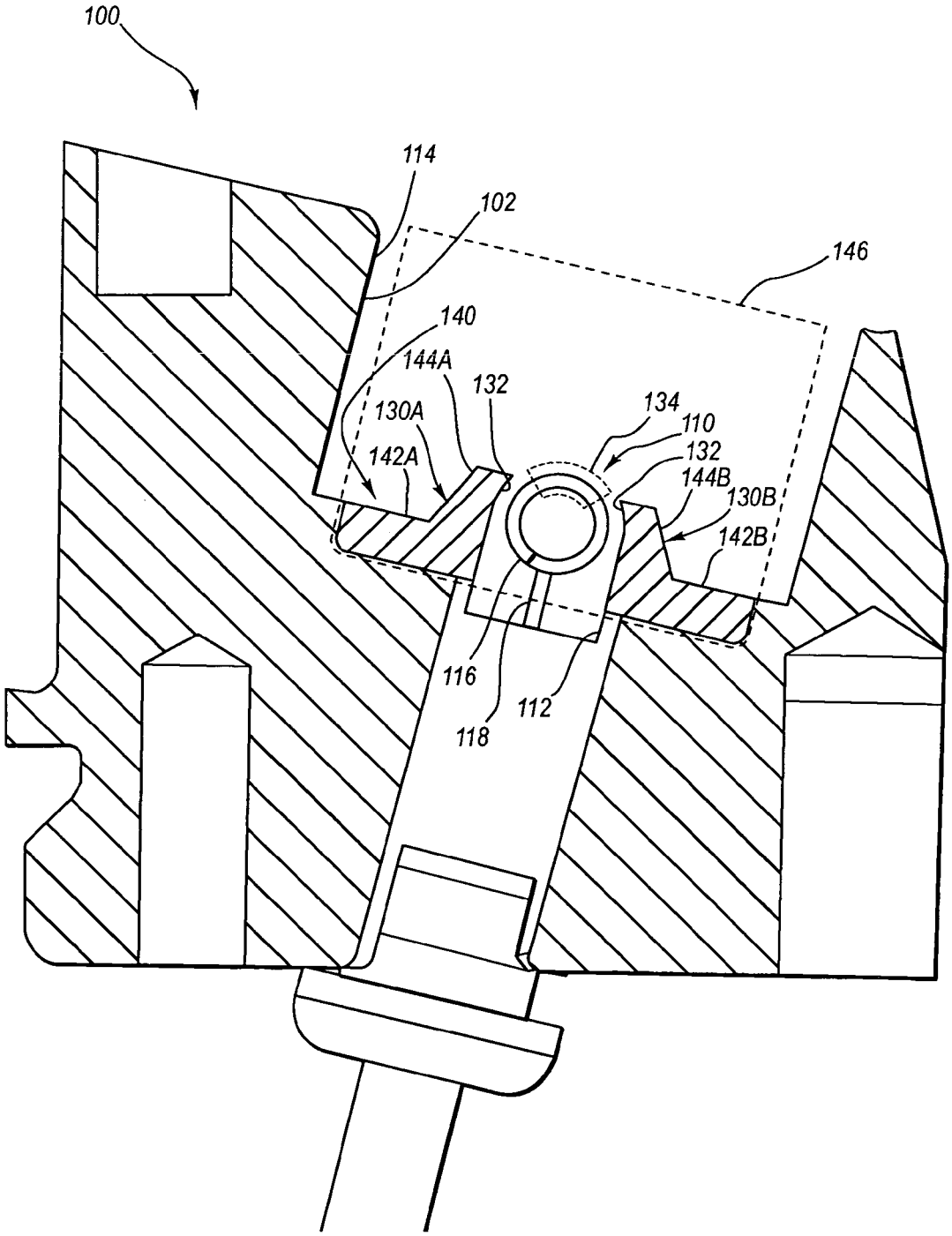
FIG. 2C is a cross sectional end view of the cathode head, taken along the line 2C-2C of FIG. 2A, illustrating various features thereof.

Together with FIG. 1, reference is now made to FIGS. 2A-2C in describing various features of one embodiment of the present invention. In particular, a cathode assembly is disclosed, including a cathode head, which is generally designated at 100. The position of the cathode head 100 relative to other tube components, and particularly with respect to the rotary anode 14, can be seen in FIG. 1. FIGS. 2A-2C shows various perspective and sectional views of the cathode head 100 and its respective components.

The cathode head 100 is manufactured from a material suitable for use in vacuum environment of the tube 10. In one embodiment, the cathode head 100 is composed of nickel, though nickel alloy, iron and its alloys, and copper can also be employed.

As shown, the head 100 defines a surface 102 and includes a recess into which a filament, generally designated at 110, is positioned. In the illustrated example, the filament 110 is positioned in a first slot 112 defined on the surface of the head 100. The first slot 112 is in turn included in a larger second slot 114. Formation of the slots 112 and 114 is discussed further below, and it is recognized that details of the cathode head surface, including the configuration and/or presence of the slots, can vary from what is described herein while still falling within the intended scope of the present invention.

FIG. 2B shows that the filament 110 in the present embodiment is a conductive wire shaped to define a plurality of coils 116 with a straight lead 118 at either wire end. The leads 118 are received into insulators 122 via holes 120 defined in the head surface 102. The filament wire in the present embodiment is composed of tungsten, a standard filament material. Other suitable filament compositions are also possible.

As best seen in FIGS. 2A and 2C, the first slot 112 is partially defined by a pair of extended surfaces 130A and 130B. The extended surfaces 130A and 130B are defined by the head surface 102 and rise from the floor of the second slot 114 adjacent the first slot 112, running parallel to the axial length of the filament 110.

The extended surfaces 130A and 130B are configured to shape the emission profile of electrons produced by the filament 110. In detail, each extended surface 130A and 130B includes a shaped inner surface 132 that corresponds to the curvature of the filament coils 116. The shaped inner surfaces 132 enable the extended surfaces 130A and 130B to be positioned substantially proximate to the filament surface. The benefits of this proximate inner surface placement is twofold: first, it inhibits electron production from all portions of each filament coil 116 except for the top region 134 of each coil, as indicated in FIG. 2C. Second, it enables relatively low magnitude cathode head control voltages to be used in controlling operation of the filament. In this way, electron emission from the filament 110 can be controlled to produce a well-defined electron stream that is directed toward the anode 14 (FIG. 1), free from off-focus electrons (i.e., "wings").

Continuing reference is made to FIGS. 2A-2C in describing various details regarding a means for protecting the filament 110 from damage or contamination, according to the present invention. In one embodiment, and as depicted in FIGS. 2A-2C, the means for protecting the filament 110 is implemented as a cathode head insert, generally designated at 140, which forms part of the cathode head 100 and solves the previously described shortcomings in the art.

In further detail, the head insert 140 is positioned about a portion of the filament 110 and defines base portions 142A and 142B, as well as extended surface portions 144A and 144B. The insert base portions 142A and 142B of the head insert 140 are configured such that they contribute to the definition of the floor of the second slot 114, while the extended surface portions 144A and 144B are configured to contribute to the structure and definition of the extended surfaces 130A and 130B, and correspondingly, the shaped inner surfaces 132. As such, these portions of the head insert 140 are respectively considered as part of the second slot 114 and extended surfaces 130A and 130B for purposes of discussion.

In the present embodiment, the head insert 140 is composed of a material suitable for its purpose of protecting the filament from damage or contamination should the filament contact a portion of the cathode head 100. As such the head insert 140 defines a "protective surface" suitable for preserving the integrity of the filament. Particularly, the head insert 140 is composed of a material that possesses a melting point that is at least substantially equal to the melting point of the material from which the filament is made. Further, the material of the head insert 140 should not form an alloy with the filament material that has a melting point substantially below that of the filament material. When the filament is composed of tungsten as is typical in the art, a suitable material of which the head insert can be composed is a refractory material, including tungsten, rhenium, tantalum, and alloys of these. In addition, other materials, such as molybdenum, osmium, niobium, iridium, hafnium, tantalum, carbide, hafnium carbide, niobium carbide, zirconium carbide, as well as other refractory materials such as the carbon doped refractory metals with hafnium could alternatively be employed. Depending on the material from which the filament is made, other materials or material combinations could be used.

Placement of the head insert as shown in the accompanying figures occurs in one embodiment during manufacture of the cathode head 100 itself. In particular, a cylindrical plug of suitable material, such as tungsten or other refractory material, is defined to correspond to the cylindrical area outlined at 146 in FIG. 2C. A suitably sized recess is drilled, machined, or otherwise defined in the cathode head 100 before definition of the slots 112 and 114 has been performed, wherein the recess closely corresponds with the size of the plug that is to become the head insert, as indicated by the area 146.

The plug is inserted and then affixed in place within the recess, such as by brazing, mechanical fastening or by another suitable technique. Note here that while it and its corresponding recess can define other shapes, e.g., square, rectangular, etc., the cylindrically shaped initial head insert plug lends well to brazing to the cathode head without the introduction of undesired air gaps between the plug and hole.

Once the head insert plug has been suitably affixed within the cathode head to occupy the area defined at 146, the cathode head can be further machined to define its various surface features, including the first and second slots 112 and 114, as well as the extended surfaces 130A and 130B. This head machining is precisely controlled such that the insert plug is machined along with other portions of the head to define the above features. As such, portions of the first slot 112, the second slot 114, the extended surfaces 130A and 130B, and the shaped inner surfaces 132 are simultaneously defined in the head insert material as well as in the native cathode head material.

Definition of the above head surface features is performed in one embodiment by a wire EDM process. Plunge EDM machining can also be used in one embodiment to define at least some of the head surface features. Those skilled in the art will recognize that these and other processes can be employed to define the cathode head as discussed and illustrated here.

Figure 3:
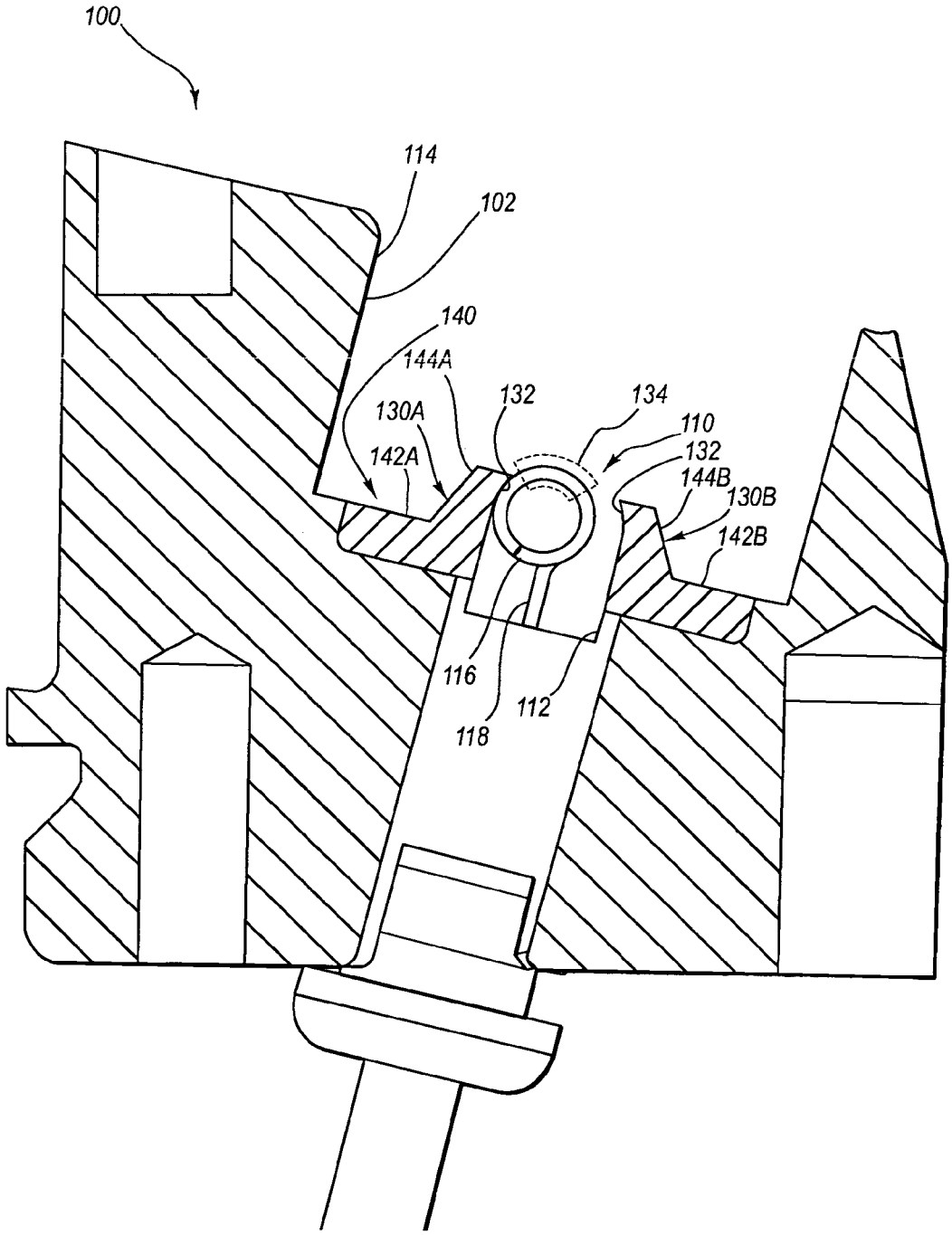
FIG. 3 is a cross sectional end view of the cathode head of FIG. 2A, showing the filament in a touching state with the cathode head surface.

Reference is now made to FIG. 3. The cathode head 100 and head insert 140 are configured to protect the filament 110 and preserve its integrity such that performance of the x-ray tube is unimpeded. In detail, the head insert 140 is centered along the axial length of the filament 110, specifically, about a filament central portion 148, shown in FIG. 2B. As described above, it is possible that during tube operation a transient physical or electrical shock event can occur that causes the filament 10 to come into contact with a portion of the cathode head 100 while the filament is operational in producing electrons. Specifically, during such an event the filament 110 may contact one of the shaped inner surfaces of the extended surfaces. Such contact, if it occurs, will be made by the central portion 148 of the filament 110, where the greatest translational freedom of the filament exists. The filament central portion 148 corresponds to the position of the head insert 140 such that if filament contact occurs, the contact will be made to the portion of the shaped inner surface 144A or 144B of the head insert 140, as depicted in FIG. 3. However, as the head insert 140 is composed in one embodiment of a refractory material having a melting point substantially equal to the material of the filament 110, the contact will not cause any fusing of the high temperature filament with the head surface to occur. Rather, the filament 110 is free to spring back to its desired position, shown in FIG. 2C. Thus, damage to the filament is prevented.

In addition to protecting the filament from fusing damage described above, the head insert 140 further protects the filament from contamination. In detail, the head insert 140 is preferably positioned such that it occupies the portions of the cathode head surface 102 closest to the relatively hottest central portion 148 of the filament 110. Thus, areas of the nickel cathode head surface 102 that were previously subjected to intense heat exposure from the operating filament sufficient to cause evaporation of the nickel onto the filament 110 are now composed of tungsten in the present embodiment, which absorbs the heat without evaporation. Further, if the filament is composed of tungsten and some evaporation does occur from the head insert 140, deposition of the evaporated tungsten atop the tungsten filament causes no contamination as the materials are identical.

It is seen from the above discussion that embodiments of the present invention serve to define various improvements over the art. In addition to precluding filament fusing or contamination, the head insert enables relatively closer head structure-to-filament spacing, thereby enabling focus control of the electron stream produced by the filament using relatively lower control voltages. Filament designs can be liberalized to allow for relatively greater filament sway with the understanding that incidental contact between the filament and cathode head surface will not result in filament damage.

In addition to the above advantages, yet further benefits are derived from the head insert of embodiments of the present invention. For instance, the head insert is composed of a material that is well suited to high electric fields and high temperature environments. This equates to better thermal, dimensional and electrical stability of the portion of the cathode head, i.e., the head insert, that is most proximate the filament. Such thermal, dimensional and electrical stability is manifested by minimization of head deformation when heated, and reduced whiskering (the formation of small "peaks" on the material surface in a high electric or high temperature field) by tungsten head insert material. Further, placement of the head insert near the hottest portion of the filament reduces catalytic interactions within the vacuum environment that sometimes occur when nickel or other traditional cathode materials are placed close to the filament. Also, inherent x-ray shielding benefits are obtained by the above-described placement of a head insert that is composed of an x-ray absorbing material, such as tungsten.

In one embodiment, the head insert can be manufactured from other tube components or materials that have reached the end of their service life. For example, the head insert plug that is used to define the head insert can be cut from rotary anodes made of tungsten and that are no longer usable as anodes. This represents a significant recycling option that reduces the amount of potentially problematic waste product that would otherwise be merely disposed of.

Figure 4:
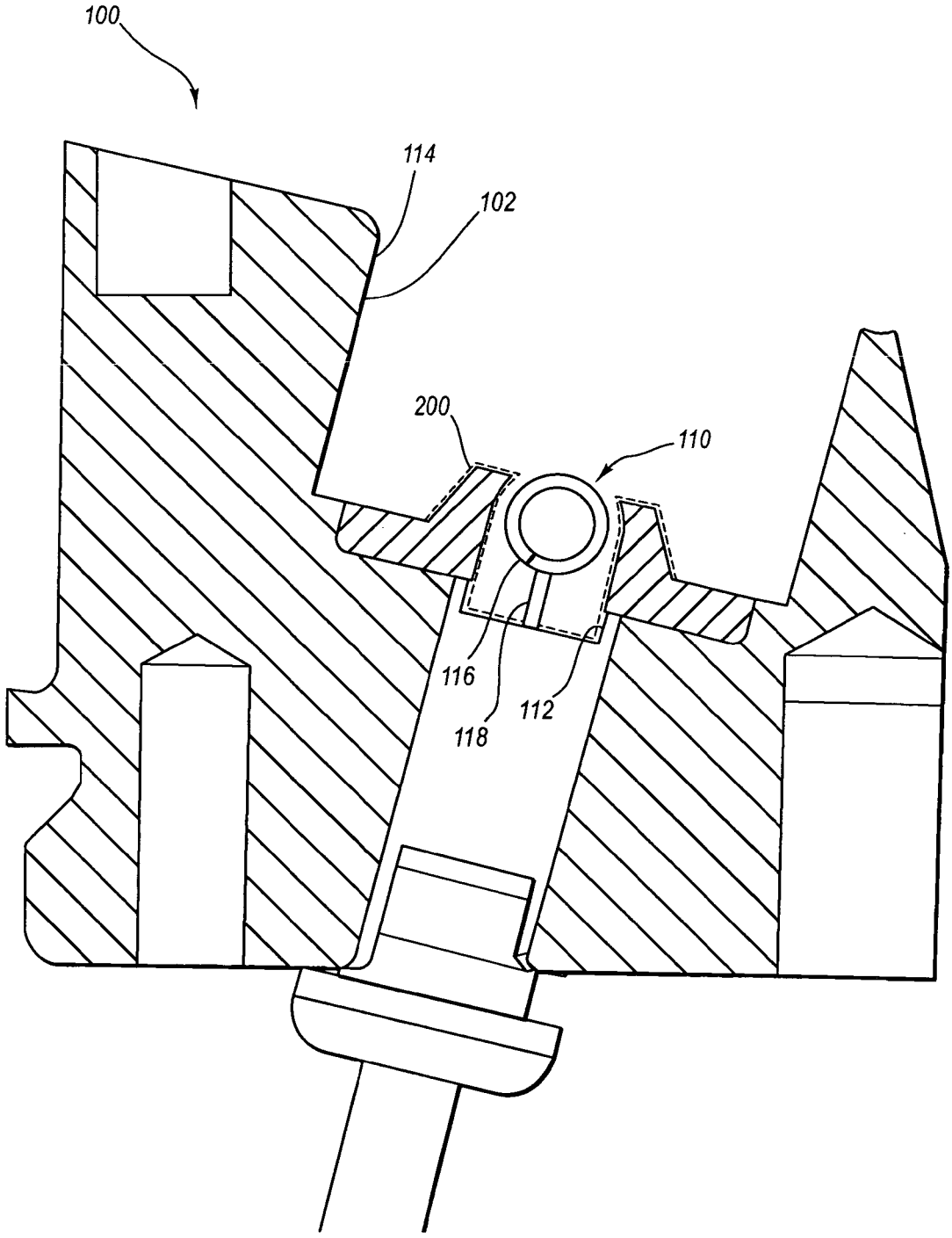
FIG. 4 is a cross sectional end view of a cathode head configured in accordance with another embodiment.

Reference is now made to FIG. 4, which describes details of another example embodiment of the present invention. As described above, the head insert 140 shown in FIGS. 2A-2C serves as one exemplary means for protecting a cathode filament from damage or contamination. Similarly, FIG. 4 describes a coating, generally indicated at 200, that serves as yet another exemplary means for protecting the filament from damage or contamination. As such, it is appreciated that the coating to be described below can be used in place of the head insert as a protective surface in protecting the filament while preserving many of the features and benefits described above in connection with the head insert.

In further detail, the coating 200 is applied in sufficient thickness to predetermined surfaces of the cathode head surface 102 proximate to the filament 110. In the illustrated embodiment, the coating is applied to portions of the first slot 112 and extended surfaces 130A and 130B, including the shaped inner surfaces 132 thereof, which are adjacent to the central portion of the filament 110, such as the central filament portion 148 shown in FIG. 2B. So applied, the coating 200 covers substantially the same area on the cathode head surface 102 as was taken up by the head insert 140 as seen in FIGS. 2A-2C.

In the present embodiment, the coating 200 is composed of tungsten and is applied to an area of the cathode head surface in a thickness sufficient to prevent fusing risk should the filament contact the coating during a transient shock event, and to prevent contamination of the filament by evaporation of head material. In one embodiment, the coating thickness is approximately 0.127 mm (0.005 inch) for a tungsten coating, though this thickness can be varied according to coating composition and intended application of the cathode and filament.

The coating 200 can be applied to the cathode head surface 102 after the cathode surface features have been defined via wire EDM or other suitable machining process. Acceptable application methods include chemical vapor deposition, plasma spray, low-pressure plasma spray, salt bath, etc.

As mentioned, the coating 200 is functionally similar to the head insert in protecting the filament during operation. Indeed, the coating 200 provides a contact surface for the cathode head 100 that will prevent fusing of the filament thereto should contact between it and the filament occur. As mentioned, in one embodiment both the filament 110 and the coating 200 are composed of tungsten, which reduces the risk of filament fusing when these two surfaces contact one another. Additionally, the coating 200 is present on portions of the cathode head surface 102 that are closest to and therefore most heated by the filament 110 during its operation. The coating composition is selected such that evaporation at these heated areas is either prevented by virtue of the coating's presence or such that any evaporation from the coating surface to the filament 110 does not contaminate the filament, such as in the case where the coating and filament compositions are substantially identical.

In yet another embodiment, it may be desirable to configure the cathode such that limited conductivity characteristics exist between the filament and the head insert or coating so as to limit current flow between the filament and the cathode head should the filament inadvertently contact the head surface during filament operation. In one embodiment, this can be accomplished by altering the composition of the head insert or coating material such that it possesses a low conductivity relative to the filament. In another embodiment, a resistive circuit or device, such as a resistor, can be placed in series between the filament and its common or ground connection. In this way, current flow between the filament and the cathode head is reduced when the filament contacts the head insert or coating, thereby reducing the amount of electrical damage that may result in the cathode head and precluding what could otherwise be a damaging high frequency event.

Note that embodiments of the present invention can be employed in x-ray tube devices of many different designs and configurations, including single and double ended tubes, rotary anode and stationary anode tubes, etc. Cathode heads having a variety of different configurations can also employ embodiments of the present invention. For instance, a cathode head having a filament mounted on its surface and having no slots or extend surfaces could nonetheless include proximate to the filament a head insert, coating, or other means for protecting the filament from damage or contamination. Or, filaments having different designs, shapes, and configurations could be employed. Moreover, application of principles of the present invention should not be limited to x-ray technology, but rather should be expanded to include cathode and filament structures that are employed in other devices where concerns regarding filament damage and contamination exist.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A cathode assembly, comprising:

a cathode head having a recess formed therein;

an insert comprising a refractory material and having a slot defined therein, a portion of the insert being positioned within the cathode head such that the slot is disposed within the recess; and a filament attached to the cathode head and substantially disposed within the slot, the filament capable of emitting electrons.

2. A cathode assembly as defined in claim 1, wherein the insert prevents the filament from fusing to the cathode head when the filament contacts the cathode head.

3. A cathode assembly as defined in claim 1, wherein the insert controls evaporation of material from the cathode head.

4. The cathode assembly as defined in claim 1, wherein the slot is partially defined by a pair of shaped inner surfaces located proximate the filament.

5. The cathode assembly as defined in claim 1, wherein the slot is at least partially defined by first and second extended surfaces of the insert, the extended surfaces extending along an axial length of the filament.

6. The cathode assembly as defined in claim 5, wherein the extended surfaces are configured to shape the emission profile of electrons produced by the filament.

7. The cathode assembly as defined in claim 5, wherein a portion of each extended surface is defined by the cathode head.

8. The cathode assembly as defined in claim 1, wherein the insert is at least partially provided as a coating comprised of tungsten.

9. A method for manufacturing a cathode head assembly, the method comprising:

defining a recess within a cathode head;

affixing an insert within the recess, the insert comprising a refractory material;

after the insert has been affixed within the recess, forming a slot within the recess such that a portion of the slot is defined within the insert; and attaching a filament to the cathode head such that at least a portion of the filament is disposed within the slot.

10. A method for manufacturing as defined in claim 9, wherein the filament comprises substantially the same material as the insert.

11. A method for manufacturing as defined in claim 9, wherein defining the recess within the cathode head comprises:

drilling a recess in a surface portion of the cathode head.

12. A method for manufacturing as defined in claim 9, wherein affixing the insert within the recess comprises:

affixing the insert via brazing.

13. A method for manufacturing as defined in claim 9, wherein a central portion of the filament is proximate to the refractory material.

14. An x-ray tube, comprising:

an evacuated enclosure;

a cathode assembly contained in the evacuated enclosure, the cathode assembly including:

a cathode head having a head surface, the head surface having a recess defined therein;

an insert defining a portion of a slot, the slot being at least partially positioned within the recess, wherein at least a portion of the insert defines a protective surface, the protective surface being comprised of a material that acts to substantially prevent fusing of the filament to the protective surface when the filament contacts the protective surface;

an electron-emitting filament partially disposed in the slot; and an anode contained in the evacuated enclosure and positioned to receive electrons produced by the filament.

15. The x-ray tube as defined in claim 14, wherein the insert comprises a refractory material.

16. The x-ray tube as defined in claim 14, wherein the insert is comprised of a material has having a melting point that is substantially equal to or above the melting point of the material of which the filament is composed.

17. The x-ray tube as defined in claim 14, wherein the insert comprises tungsten.

18. The x-ray tube as defined in claim 14, wherein the slot is partially defined by first and second extended surfaces, the extended surfaces extending along an axial length of the filament.

19. The x-ray tube as defined in claim 18, wherein a portion of each extended surface is defined by the insert.

20. The x-ray tube as defined in claim 14, wherein the cathode head includes a material selected from the group consisting of nickel, iron, copper, molybdenum and alloys of nickel, iron, copper and molybdenum.

21. The x-ray tube as defined in claim 14, wherein the insert is comprised of a material is selected from the group consisting of tungsten, rhenium, tantalum, molybdenum, osmium, niobium, iridium, hafnium, tantalum, carbide, hafnium carbide, niobium carbide, and zirconium carbide.

* * * * *

UNITED STATES PATENT AND TRADEMARK OFFICE

CERTIFICATE OF CORRECTION

PATENT NO. : 7,657,002 B2
APPLICATION NO. : 11/343599
DATED : February 2, 2010
INVENTOR(S) : Burke et al.

It is certified that error appears in the above-identified patent and that said Letters Patent is hereby corrected as shown below:

Title Page, item 57 Right Column
Abstract, line 14, change "configure" to --configured--

Column 2
Line 5, change "shaped" to --shaped and--
Line 48, change "cathode" to --the cathode--
Line 55, change "have" to --have been--

Column 5
Line 34, change "vacuum" to --a vacuum--
Line 59, change "adjacent" to --adjacent to--

Column 7
Line 29, change "10" to --110--

Column 9
Line 43, change "extend" to --extended--

Column 11
Line 2, delete "has"

Column 12
Line 3, insert a --:-- after "consisting of"
Line 6, delete the second instance of "is"
Line 7, insert a --:-- after "of"

Signed and Sealed this
Twenty-eighth Day of December, 2010

David J. Kappos

David J. Kappos
*Director of the United States Patent and Trademark Office*